United States Patent [19]

Neubauer

[11] 4,143,891

[45] Mar. 13, 1979

[54] NEGOTIABLE DOCUMENT

[75] Inventor: Frank Neubauer, Mt. Kisco, N.Y.

[73] Assignee: Transkirt Corporation, Elmsford, N.Y.

[21] Appl. No.: 755,207

[22] Filed: Dec. 29, 1976

[51] Int. Cl.[2] ..... B41L 5/00; B41M 5/10

[52] U.S. Cl. ..... 282/27.5; 427/7; 427/153; 427/261; 428/326; 428/486; 428/488; 428/913; 428/914; 428/915; 428/916

[58] Field of Search ..... 282/27.5; 428/915, 916, 428/486, 488, 326, 913, 974; 427/7, 153, 261

[56] References Cited

U.S. PATENT DOCUMENTS

| | | | |
|---|---|---|---|
| 2,035,768 | 3/1936 | Sherman et al. | 282/27.5 |
| 2,164,685 | 7/1939 | Kinyon | 427/153 X |
| 2,503,680 | 4/1950 | Newman | 282/27.5 |
| 3,104,799 | 9/1963 | Steidinger | 282/27.5 X |
| 3,376,154 | 4/1968 | Campbell et al. | 427/153 X |
| 3,908,063 | 9/1975 | Rosendale et al. | 427/153 X |
| 3,963,853 | 6/1976 | Hughes et al. | 428/488 X |
| 3,996,406 | 12/1976 | Alsop | 428/307 |

*Primary Examiner*—Thomas J. Herbert, Jr.
*Attorney, Agent, or Firm*—Kenyon & Kenyon, Reilly, Carr & Chapin

[57] ABSTRACT

The negotiable document which may be used, e.g. by airlines includes a cover sheet provided with a hot spot carbon or other image transfer medium and at least one underlying sheet fully or partly coated with microcapsules of a dye intensifier and attractor. When information is imprinted on the cover sheet, the microcapsules of the dye intensifier in the underlying sheet are burst to wet the sheet and, thus, allow impregnation of the image transferred by the hot spot carbon into the fibers of the sheet. At the same time, the dye within the hot spot carbon is attracted into the sheet. The impregnation of the sheet is sufficient to prevent removal of the image from the underlying sheet without first destroying the sheet or mutilating it in such a manner that the defalcation effort is obvious.

2 Claims, 4 Drawing Figures

NEGOTIABLE DOCUMENT

This invention relates to a negotiable documents in general and to airline tickets in particular.

As is known, various types of travel tickets, particularly airline tickets, are made up of a plurality of overlying sheets with designated spaces for receiving information. In many cases, the top sheet of such a ticket is used as an original with information concerning a trip placed thereon, for example by a highspeed printer or typewriter, and the original retained by the ticker sellor. In such cases, the underlying sheets are used as copies of the original and are given to the ticket purchaser to use during the trip. For example, when a ticket is purchased from an airline, this cover sheet is imprinted to show a trip, for example, from New York to Chicago and the cost of the trip. At this time, the underlying sheets of the ticket are also provided with a duplicate of this information via an image transfer medium.

However, it has been found that tickets of the above nature can be fraudulently changed. For example, the copies can be changed by removing the image "Chicago" as a terminus of the trip and inserting the same with a designation, such as "San Francisco". Thus, the copies indicate the end point of the trip as San Francisco rather than Chicago. In this way, the user can fly to San Francisco while having paid only for a trip to Chicago.

Accordingly, it is an object of the invention to provide a negotiable document such as an airline ticket which is difficult to fraudulently change.

It is another object of the invention to form a virtually permanent image copy of original information on an airline ticket.

It is another object of the invention to provide a ticket for commercial travel which cannot be readily changed.

Briefly, the invention provides a ticket, such as an airline ticket, with a cover sheet and at least one duplicating sheet under the cover sheet. The cover sheet is provided with spaces on a front surface to receive information and an image transfer medium, such as a hot spot carbon, on the back surface. The duplicating sheet is provided with spaces on a front surface under the image transfer medium to receive an image of the information placed in the spaces of the cover sheet. In addition, means are provided on the front surface of the duplicating sheet to impregnate the duplicating sheet with the received image.

The means for impregnating the underlying sheet with the transferred image is in the form of a coating of microcapsules of a dye intensifier and attractor which is suitable for the image transfer medium used on the cover sheet. For example, where the image transfer medium is a hot spot carbon containing waxes, oil, pigments and dyes, the coating is formed of microcapsules of oleic acid.

When in use, information is printed on the front surface of the cover sheet and an image of this information is transferred via the image transfer medium onto the front surface of the underlying duplicating sheet. At the same time, the microcapsules of the oleic acid are ruptured and the acid not only wets the surface of the underlying sheet to permit impregnation of the image into the sheet but also attracts the dye of the image transfer medium into the fibers of the paper of the underlying duplicating sheet.

The invention may be used in any type of negotiable document employing overlying sheets such as described above. For example, the invention may be used in tickets for airline, train, bus, or any other means of commercial transportation, or any other negotiable document.

These and other objects and advantages of the invention will become more apparent from the following detailed description and appended claims taken in conjunction with the accompanying drawings in which:

Figure 1:
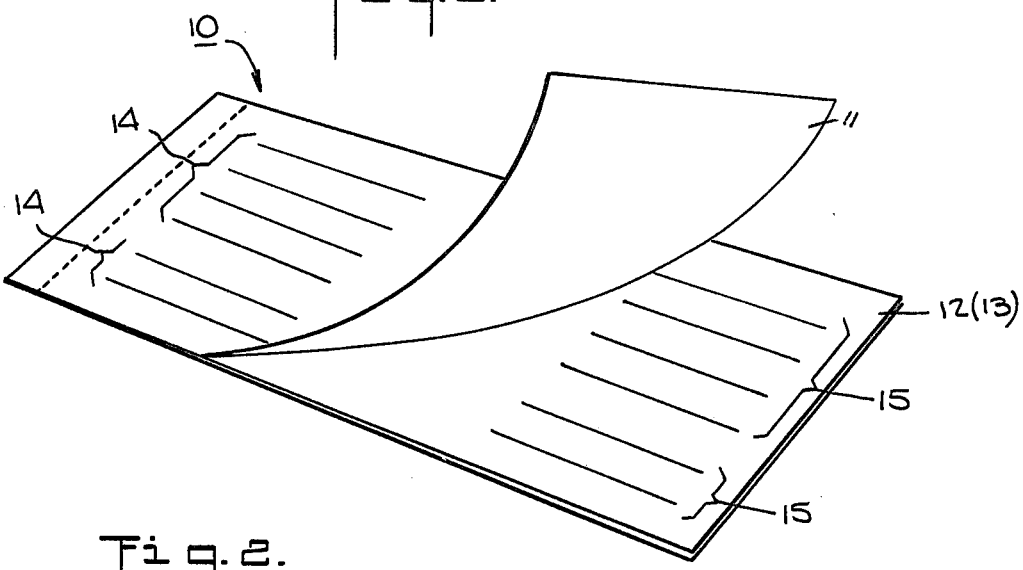
FIG. 1 illustrates a perspective view of an airline ticket according to the invention.

Referring to FIG. 1, the airline ticket 10 is composed of a cover sheet 11 and one or more underlying sheets 12 (13). The underlying sheets 12 (13) are substantial duplicates of the cover sheet 10 and are described hereinafter as "duplicating sheets". The cover sheet 11 has a plurality of designated spaces 14 on a front surface to receive information, for example, information concerning a trip from a point of embarkation to a point of debarkation as well as the price of the ticket for travel between these two points. The duplicating sheets 12 (13) also have designated spaces 15 on a front surface thereof to receive an image of the information placed in the spaces 14 of the cover sheet 11.

Figure 3:
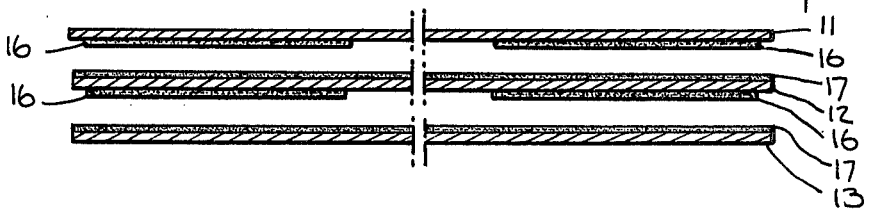
FIG. 3 illustrates an exploded cross sectional view of the airline ticket of FIG. 1.

Referring to FIG. 3, the cover sheet 11 includes a layer or layers of an image transfer medium 16, for example, a hot spot carbon, on the back surface in alignment wth each of the designated spaces 14 on the front surface. Similarly, if more than one duplicating sheet is used, as shown, the overlying duplicating sheet 12 is provided with a similar layer or layers of an image transfer medium 16.

In general, the airline ticket 10 is of known construction and need not be further described except as hereinafter.

The underlying duplicating sheet 12 is also provided with a means on the front surface to impregnate the duplicating sheet 12 with a received image. This means is in the form of a coating 17 of microcapsules of a dye intensifier and attractor; the coating 17 being placed over all or a portion of the surface of the duplicating sheet 12. Where more than one duplicating sheet is used, the underlying duplicating sheet 13 also contains a similar coating 17. Generally, where the image transfer medium 16 is a hot spot carbon, such contains a composition which includes about 40% wax, 40% oil, 18% pigment and 2% dye. In this case, the dye intensifier and attractor in the coating 17 is oleic acid. However, any other suitable dye intensifier and attractor can be used.

Figure 2:
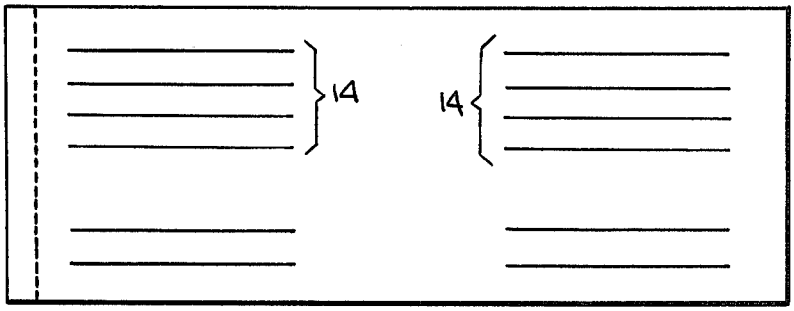
FIG. 2 illustrates a front view of the ticket of FIG. 1.
Figure 4:
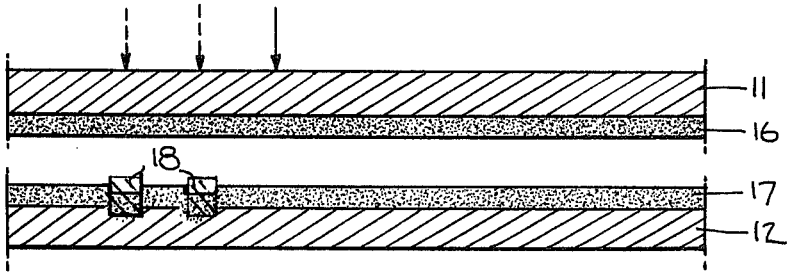
FIG. 4 illustrates a schematic view of the manner of transferring an image according to the invention.

Referring to FIGS. 2 and 4, when in use, information is placed in the spaces 14 on the cover sheet 11 of the ticket and a duplicate image is transferred via the hot spot carbon layer 16 onto the designated spaces 15 of the underlying cover sheets 12 (13). At the same time, the instrument, e.g. a highspeed printer or typewriter, used to place the information on the cover sheet 11, bursts the microcapsules in the coating 17 so that the oleic acid or the like wets the surface of the duplicating sheet 12 (13). This permits impregnation of the fibers of the duplicating sheet 12 with the transferred image 18. Also, the oleic acid intensifies the dye of the transferred image 18. In this way, the duplicating sheet(s) 12 (13) contains a sharp integrated image of the information on the cover 11. Thus, it becomes difficult, if not impossible, to remove this impregnated image 18 without destroying the duplicating sheet 12 (13) or clearly revealing the defalcation effort. Thus, the integrity of the information originally transferred onto the duplicating sheet(s) 12 (13) is preserved.

What is claimed is:

1. A negotiable document comprising a cover sheet having designated spaces on a front surface thereof to receive information and a layer of hot spot carbon on a back surface thereof in alignment with each of said designated spaces; and at least one duplicating sheet disposed under said cover sheet, said duplicating sheet having designated spaces on a front surface thereof to receive a copy of the information placed on said spaces of said cover sheet and a coating of microcapsules of oleic acid for impregnating said duplicating sheet with the received copy.

2. A duplicating sheet comprising a plurality of designated spaces on a front surface thereof to receive a carbon image, and a coating of a microencapsulated oleic acid on said front surface over said designated spaces for impregnating a received carbon image into said sheet.

* * * * *

UNITED STATES PATENT AND TRADEMARK OFFICE

CERTIFICATE OF CORRECTION

PATENT NO. : 4,143,891

DATED : March 13, 1979

INVENTOR(S) : Frank Neubauer

It is certified that error appears in the above-identified patent and that said Letters Patent are hereby corrected as shown below:

Cover Sheet, item "73" change "Transkirt" to -- Transkrit--

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*